US008568251B2

(12) United States Patent
Hogge et al.

(10) Patent No.: US 8,568,251 B2
(45) Date of Patent: Oct. 29, 2013

(54) IN-MOLD POWDER COATING OF GOLF BALL EQUIPMENT AND METHODS OF MAKING THE SAME

(75) Inventors: Matthew F. Hogge, Plymouth, MA (US); Peter L. Serdahl, New Bedford, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 12/845,892

(22) Filed: Jul. 29, 2010

(65) Prior Publication Data

US 2010/0304891 A1 Dec. 2, 2010

Related U.S. Application Data

(63) Continuation of application No. 11/738,537, filed on Apr. 23, 2007, now Pat. No. 7,789,775.

(51) Int. Cl.
*A63B 37/12* (2006.01)

(52) U.S. Cl.
USPC ..... 473/378

(58) Field of Classification Search
USPC ..... 473/378, 373, 374
See application file for complete search history.

(56) References Cited

U.S. PATENT DOCUMENTS

| | | | | |
|---|---|---|---|---|
| 5,849,168 | A * | 12/1998 | Lutz | 264/255 |
| 6,315,915 | B1 * | 11/2001 | Hebert et al. | 216/67 |
| 6,548,618 | B2 * | 4/2003 | Sullivan et al. | 528/76 |
| 6,606,332 | B1 | 8/2003 | Boscha | |
| 6,632,147 | B2 | 10/2003 | Cavallaro et al. | |
| 6,843,734 | B2 * | 1/2005 | Iwami | 473/378 |
| 6,843,735 | B2 * | 1/2005 | Sajima et al. | 473/383 |
| 6,852,045 | B2 * | 2/2005 | Ohama et al. | 473/384 |
| 6,855,076 | B2 * | 2/2005 | Matroni et al. | 473/378 |
| 2003/0004013 | A1 * | 1/2003 | Lutz et al. | 473/374 |

* cited by examiner

*Primary Examiner* — Raeann Gorden
(74) *Attorney, Agent, or Firm* — Daniel W. Sullivan

(57) ABSTRACT

A golf ball having an inner core and a cover or intermediate layer made from a non-ionomeric polyolefin composition is provided. The method for making the golf ball includes the step of adhering a thin layer of a non-ionomeric polyolefin powder to the interior surfaces of a golf ball mold. The polyolefin powder is adhered to the mold using electrostatic, tribostatic or fluidized bed processes. A golf ball component is placed within the mold, and a sufficient amount of heat and pressure is applied to the mold so that the thin layer of non-ionomeric polyolefin powder fuses to the golf ball component.

3 Claims, No Drawings

IN-MOLD POWDER COATING OF GOLF BALL EQUIPMENT AND METHODS OF MAKING THE SAME

CROSS-REFERENCE TO RELATED APPLICATIONS

This application is a continuation of co-assigned U.S. patent application Ser. No. 11/738,537 having a filing date of Apr. 23, 2007 now U.S. Pat. No. 7,789,775, now allowed, the entire disclosure of which is hereby incorporated by reference.

FIELD OF THE INVENTION

The present invention relates to golf balls and, more particularly, to a method of coating thin layers on a variety of golf ball components and/or golf equipment.

BACKGROUND OF THE INVENTION

The modern golf ball may be constructed in a number of ways. By altering ball construction and composition, manufacturers can vary a wide range of playing characteristics, such as resilience, durability, spin, and "feel," each of which can be optimized for various playing abilities.

Manufacturers can adjust the properties of golf balls by varying the construction of golf ball intermediate and cover layers. These layers have conventionally been formed by compression or injection molding various polymer materials, such as ionomers and polyurethanes of varying hardness and flexural modulus. Injection and compression molding have practical limitations on layer thickness. It remains a challenge to mold a layer having a thickness of less than about 0.03 inches. In addition, once layers become very thin uniformity problems arise. Other types of molding, such as casting and reaction injection molding ("RIM") also have limitations. Casting processes generally have undesirable waste, and RIM mold parts are difficult to position to achieve a uniform layer and may leave pin marks on the cores or golf ball subassemblies. Thin layers may also be sprayed on the golf ball assemblies; however, spray applicators or nozzles can be clogged and the liquid compositions to be sprayed may also have undesirably high volatile organic components (VOC).

Other methods used to apply layers to a golf ball utilize electrostatic application of a powder coating to golf ball cores or subassemblies. These types of applications, however, require an electrostatic precursor coating, i.e. RansPrep™ available from Chemical Technology Co., to create a conductive environment on the cores or subassemblies for the powder coating to attach. In addition, complex holding fixtures are required to hold the golf ball subassemblies. The precursor coating is an additional processing step. The holding fixtures are complex because the fixture as a whole should not be conductive, but should be conductive at the holding points. Also, the fixtures typically leave "pick marks" on the cores or subassemblies. Furthermore, powder application of the cores or subassemblies requires additional high temperature heating, i.e. infrared heating, to cure or to melt the powder into a smooth coating.

Therefore, the need remains for methods to apply thin uniform layers to golf balls without the need for additional coatings or complicated fixtures.

SUMMARY OF THE INVENTION

The present invention provides a thin and uniform, i.e., less than about 15 mil, layer of a non-ionomeric polyolefin coating in a golf ball as either the cover or an intermediate layer. Application of this thin layer is achieved by coating the interior surface of a golf ball mold using either an electrostatic, tribostatic or fluidized bed process. The entire assembly is then heated to create a uniform coating. Examples of suitable powders include, but are not limited to, polyethylene powder, ethylene acrylic acid powder and polypropylene powder.

DETAILED DESCRIPTION OF THE INVENTION

The present invention is directed to methods and systems for providing a thin coating on a golf ball component, i.e., a thin cover or intermediate layer over a golf ball core. The golf balls of the present invention include any of a variety of constructions, from a two-piece ball formed of a core and cover, to a three-piece dual core single cover to any multi-piece construction, but preferably include a core formed of a center and at least one outer core layer and a cover formed of an outer cover layer and possibly at least one inner cover layer. An intermediate or mantle layer may be disposed between the core and the cover of the golf ball. The innermost portion of the core, while preferably solid, may be a hollow or a liquid-, gel-, or air-filled sphere. As with the core, the cover layers may also comprise a plurality of layers, at least one of which may be an adhesive or coupling layer. The layers may be continuous or non-continuous (i.e., grid-like). The core may also include a wound layer made from many yards of a tensioned elastomeric material.

In accordance with one exemplary embodiment of a method for coating a golf ball component in accordance with the present invention, a layer comprising at least one polyolefin powder is adhered to at least one part of a multi-part golf ball mold using a tribostatic process, an electrostatic process, a fluidized bed process and combinations thereof. Preferably, the layer of non-ionomeric polyolefin powder is adhered to each part of the multi-part golf ball mold. Any suitable type of golf ball mold can be used including injection and compression type molds. In one embodiment, a two-part golf ball compression mold is used.

In the electrostatic process, a corona electrostatic spray gun is used to apply the polyolefin powder from a feed hopper by utilizing the electrostatic charge of the powder particles. The corona gun utilizes a voltage supply to charge the powder particles, thereby negatively charging the particles. This generates electric fields, which can cause the particles to coat the surface of the mold evenly. On the other hand, the tribostatic process utilizes a tribo electrostatic spray gun that uses friction generated within the gun barrel. The tribo gun positively charges the particles, resulting in even coating of the powder. Suitable methods for utilizing corona and tribo spray guns are known and available in the art.

The fluidized bed process immerses the golf ball mold parts in a fluidized bed of the polyolefin powder. The polyolefin powder is placed in a reservoir, such as an open-top immersion tank. Any suitable method for grinding the polyolefin into a powder can be used. Suitable sizes for the particles of polyolefin powder include, but are not limited to, less than about 100 μm, preferably less than about 75 μm and more preferably less than about 50 μm. The reservoir containing the polyolefin powder is "fluidized" by injecting low pressure, dry compressed air through a porous diffuser plate or manifold at the bottom of the reservoir. Injection pressures preferably range from about 5 psig to about 15 psig, and the dew point is typically controlled, preferably kept below 30° F. While any air flow rate is acceptable, an air flow rate on the order of about 5 cubic feet per minute per square foot of diffuser plate is preferred. In one embodiment, air is introduced into the reservoir and percolates up through the powder to ensure particle separation. In this way, the powder entrained with air has a substantial density reduction and takes on the consistency of a "fluid" so that the mold parts can be freely "dipped" into and lifted out of the "fluidized powder bed."

The polyolefin powder can be charged positively or negatively. In one embodiment of the present invention, the mold parts to be coated are charged (and optionally heated) prior to entering the fluidized bed for electrostatic coating with the charged polyolefin powder. In another embodiment of the present invention, the mold parts to be coated are grounded (and optionally heated) prior to entering the fluidized bed for electrostatic coating with charged polyolefin powder. Any number of methods may be used to electrostatically charge either the mold parts or the polyolefin powder (if necessary). One method of coating the mold when the mold needs help holding the charge is to coat the mold with a metal salt solution, such as RansPrep™, commercially available from Chemical Technology Co, disclosed in U.S. Pat. No. 6,706,332, which is incorporated herein by reference in its entirety.

In one embodiment, adhesion of the polyolefin powder to the golf ball mold parts is facilitated by grounding the mold parts by any suitable method and applying a voltage, preferably a negative voltage (e.g., 10-20 kV), to the polyolefin powder, typically via a set of electrodes positioned near the air diffuser plate. The resultant electrostatic field causes polyolefin powder at the top of the fluidized bed to leave the bed to form a "cloud" of charged polyolefin powder. Golf ball mold parts conveyed through the powder cloud attract the charged particles, which adhere to their surfaces.

Any polyolefin powder capable of adhering to the golf ball mold and or producing the desired properties in the golf ball can be used. In one embodiment, the polyolefin powder is a non-ionomeric polyolefin powder. Suitable non-ionomeric polyolefin materials include, but are not limited to, low density polyethylene, linear low density polyethylene, high density polyethylene, polypropylene, rubber-toughened olefin polymers, acid copolymers which do not become part of an ionomeric copolymer when used in the outer cover layer, plastomers, flexomers, and thermoplastic elastomers such as SIRS (styrene/butylene/styrene) or SEBS (styrene/ethylene-butylene/styrene) block copolymers, including Kraton (Shell), dynamically vulcanized elastomers such as Santoprene (Monsanto), ethylene vinyl acetates such as Elvax (DuPont), and ethylene methyl acrylates such as Optema (Exxon), or mixtures thereof. In one embodiment, it is desirable that the polyolefin be a tough, low density material. A single polyolefin can be included in the powder, or, alternatively, a mixture of two or more polyolefins, such as epoxy-acid curing powders, urethane powders and blocked urethane powders, can be included in the powder. Other suitable polyolefin powders include two-component thermoset polymers and one-component thermoset polymers. Two-component thermoset polymers are disclosed in commonly owned U.S. Pat. No. 6,632,147 B2, which is incorporated herein in its entirety.

Suitable polyolefin powders can be a thermoplastic powder, which forms a thermoplastic layer after the molding process. Also, suitable polyolefin powders can be a powder that comprises two components or can be a powder that requires heat to cure or cross-linked to from a thermoset layer. A non-limiting example of a powder that can be molded to form a thermoset layer is blocked isocyanate powder.

Having adhered the polyolefin powder layer to the mold portions, a golf ball component is placed within the multi-part golf ball mold. Therefore, the layer of powder surrounds at least a portion and preferably the entire circumference of the golf ball component. As used herein, the golf ball component includes any portion of a two-layer or multi-layer golf ball including a core, a number of inner layers surrounding the core and/or an inner cover layer. In one embodiment, the powder layer will form the golf ball cover layer, and the golf ball component comprises all inner layers of the golf ball. In another embodiment, the powder layer constitutes an intermediate layer.

Having placed the golf ball component into the golf ball mold, a sufficient amount of heat and pressure is applied to multi-part mold to fuse the adhered layer of polyolefin powder to the golf ball component. Suitable process conditions and methods for melting and fusing the polyolefin powder are known in the art. These steps can be repeated for the application of subsequent layers.

Excess polyolefin powder can be removed, e.g., by vacuuming and be reclaimed and reused.

Furthermore, the golf ball cores or subassemblies can be pre-heated to about 100° F.-175° F., if their temperature falls below this range before being molded.

To facilitate the adhesion of the powder polyolefin to the cores or subassemblies or mold parts, the mold parts or the golf cores/subassemblies can be treated with corona treatment, plasma treatment or chemical treatment. Additionally, a coupling agent, such as amino-silane, commercially available from OSI Specialty Chemical, can also be used to improve adhesion. Alternatively, instead of the corona, plasma or chemical treatments, the mold parts or the golf cores/subassemblies can be mechanically agitated by vibrating, tumbling or brushing to improve adhesion to the powder.

In another embodiment, the golf ball cores or subassemblies are coated with the polyolefin powder and are treated to increase the adhesion between the cores/subassemblies to the polyolefin powder by one or more of the chemical or mechanical processes discussed above. Another layer, such as a cover layer or an outer intermediate layer, can be added on top of the layer formed from polyolefin layer.

Exemplary methods in accordance with the present invention described above facilitate the adhesion of very thin layers to the golf ball mold, yielding correspondingly thin and uniform yet durable layers on the golf ball. In one embodiment, the layer has a thickness of less than about 15 mils. Preferably, the layer has a thickness of less than about 10 mils. More preferably, the layer has a thickness of less than about 8 mils or less than about 5 mils. A layer as thin as less than about 3 mils, i.e., about 2.8 mils, has been molded on to golf cores and golf subassemblies.

In one embodiment, a conventional golf ball, e.g., having a diameter of about 1.680 inches, can have an unconventionally large core. Such a golf ball would have a core of 1.650 and a cover or outer skin of 15 mils, a core of 1.660 and a cover or outer skin of 10 mils, or a core of 1.674 inches and a cover or outer skin of 3 mils. It is very well known that the core of a golf ball is the "engine" of the ball, and a larger core would produce a ball with a higher coefficient of restitution. This inventive golf ball could exhibit performance features previously unknown due to core/construction limitations caused by current cover molding processes that limit the cover to 20-30 mils. In this inventive golf ball, the dimples may penetrate into the core itself due to the thinness of the cover.

The present multilayer golf ball can have an overall diameter of any size. Although the United States Golf Association ("USGA") specifications limit the minimum size of a competition golf ball to 1.680 inches. There is no specification as to the maximum diameter. Golf balls of any size, however, can be used for recreational play. The preferred diameter of the present golf balls is from about 1.680 inches to about 1.800 inches. The more preferred diameter is from about 1.680 inches to about 1.7560 inches. The most preferred diameter is about 1.680 inches to about 1.690 inches.

The method and materials of the present invention may also be used to coat golf equipment, in particular, inserts for golf clubs, such as putters, irons, and woods, and in golf shoes and components thereof.

Other than in the operating examples, or unless otherwise expressly specified; all of the numerical ranges, amounts, values and percentages such as those for amounts of materials and others in the specification may be read as if prefaced by the word "about" even though the term "about" may not expressly appear with the value, amount or range. Accordingly, unless indicated to the contrary, the numerical parameters set forth in the specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contain certain errors necessarily resulting from the standard deviation found in their respective testing measurements. Furthermore, when numerical ranges of varying scope are set forth herein, it is contemplated that any combination of these values inclusive of the recited values may be used.

What is claimed is:

1. A golf ball, comprising:

a golf ball component comprising an inner core and inner cover layer, wherein the inner cover layer is treated with an amino-silane coupling agent; and a coated outer cover layer having a thickness of less than 3 mils and comprising a fused powder polyolefin composition, the outer layer being coated on the golf ball component, the fused powder polyolefin composition being formed by adhering a layer comprising polyolefin powder to a multi-part golf ball mold using a tribostatic, electrostatic or fluidized process; placing the golf ball component in the multi-part golf ball mold; and applying a sufficient amount of heat and pressure to the multi-part mold to fuse the polyolefin composition to the golf ball component.

2. The golf ball of claim 1, wherein the polyolefin powder comprises a non-ionomeric polyolefin powder.

3. The golf ball of claim 2, wherein the non-ionomeric polyolefin powder comprises a material selected from the group consisting of SBS (styrene/butylene/styrene), SEBS (styrene/ethylene-butylene/styrene), polyethylene, polypropylene, ethylene vinyl acetate, and ethylene methyl acrylate, and mixtures thereof.

* * * * *